United States Patent [19]

Johann et al.

[11] Patent Number: 4,715,793

[45] Date of Patent: Dec. 29, 1987

[54] FLOW REGULATING ROTARY VANE PUMP

[75] Inventors: Merz Johann, Schwäbisch Gmünd; Seidl Günther, Heubach, both of Fed. Rep. of Germany

[73] Assignee: Zahnradfabrik Friedrichshafen, AG., Friedrichshafen, Fed. Rep. of Germany

[21] Appl. No.: 857,756

[22] PCT Filed: Jul. 30, 1985

[86] PCT No.: PCT/EP85/00384

§ 371 Date: Apr. 3, 1986

§ 102(e) Date: Apr. 3, 1986

[87] PCT Pub. No.: WO86/01261

PCT Pub. Date: Feb. 27, 1986

[30] Foreign Application Priority Data

Apr. 11, 1984 [LU] Luxembourg ..... 00246

[51] Int. Cl.[4] ..... F04B 49/00

[52] U.S. Cl. ..... 417/300; 417/310

[58] Field of Search ..... 417/300, 310

[56] References Cited

U.S. PATENT DOCUMENTS 3,314,495 4/1967 Clark et al. ..... 180/79.2

3,349,714 10/1967 Griener ..... 417/300

3,989,414 11/1976 Rieber ..... 417/300

*Primary Examiner*—William L. Freeh

*Attorney, Agent, or Firm*—Zalkind & Shuster

[57] ABSTRACT

A rotary vane pump has a pressure operated valve to bypass pump outlet flow to the inlet of the pump for flow regulation. A metering throttle bore, downstream of a choke bore, responsive to viscosity is a passage from the pump to a consumer such as a servosteering system. Responsiveness to viscosity is effected by providing an area in cross section for flow passage in the metering bore, which flow area is much smaller than the wetted surface area of the passage. A pressure agent at a cold temperature having greater viscosity than that at a higher temperature will effect flow regulation of the pump sooner than the high temperature pressure agent. Since for a cold pressure agent the viscosity is higher, the resistance to flow through the metering throttle bore is greater. As a result, the pump must work at a higher pressure which actuates the pressure operated valve to effect bypass flow. Thus, a greater portion of the pump output is circulated in the pump which minimizes pump noise during pump start up with a cold pressure agent.

11 Claims, 5 Drawing Figures

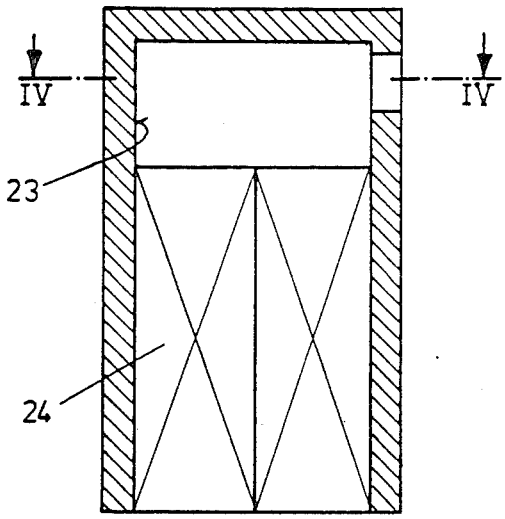
FIG. 3
FIG. 4
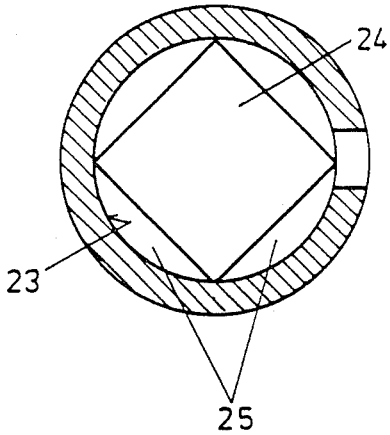
FIG. 5
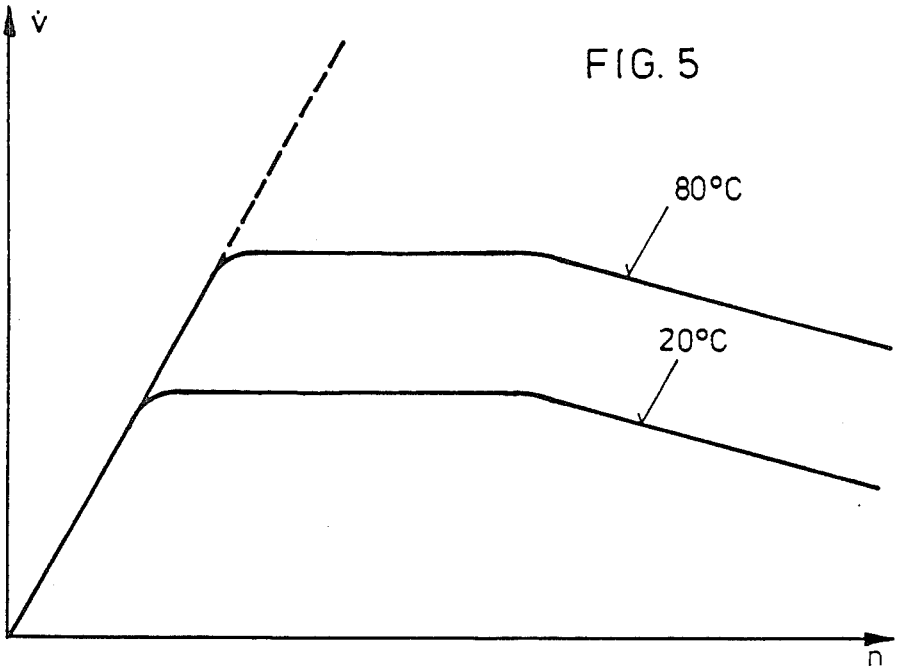

FLOW REGULATING ROTARY VANE PUMP

The invention relates to a flow regulating arrangement for a rotary vane pump with regulation of pump output flow by means of a bypass flow regulating valve in which a metering throttle has been disposed.

The arrangment as heretofore been known in the German Pat. No. 24 02 017 (U.S. Pat. No. 3,989,414). A rotary vane pump having such a flow regulating arrangement has the disadvantage that in starting of the pump, especially at low temperature, undesirable noises develop.

The present invention has for its purpose, the avoidance of such starting noises with pumps of the kind described.

Such purpose is effected by utilization of a viscosity responsive metering throttle.

In the prior art of rotary vane pumps (German patent application No. P 34 23 812.3, U.S. Pat. No. 33 49 714), a variable metering throttle is used as a restricted orifice operable independently of viscosity. This means that the quantity of pressure agent, e.g., oil flowing to a consumer, i.e., a servosteering system is independent of the temperature of the oil for low and high temperatures, causing noise. The passage length of the throttling is made as short as possible in the prior art as compared with the present invention. The flow at reduced pressure for the regulation of pump flow thus takes place downstream of the variable throttle.

Accordingly when the discharge rate of the prior art pump amounts, for example, to 8 liters/min., 7 liters/min. are pumped to the consumer, and the bypass flow back to the suction side of the pump from the flow regulating valve amounts only to 1 liter/min. In order to pump 8 liters/min. it's necessary for the pump to maintain a flow of 7 liters/min. from the tank.

For low oil temperatures, injector action, i.e., the entraining effect on oil from the tank is not sufficient as effected by the bypass flow because of the viscosity of the oil to maintain a suction of the required 7 liters/min. The cavitation developing thereby leads to the undesirable noises.

In the present invention, a flow regulating valve with a metering throttle responsive to oil viscosity is used and in event of low temperature, the final regulation occurs sooner than would occur in the prior art and thus less oil need be conveyed to the consumer. Accordingly, a smaller quantity of oil goes to the consumer, while the main quantity pumped is bypassed to the suction side of the pump. In consequence only a very small quantity of oil needs to be replenished from the tank so that no heavy flow cavitation with accompanying noise will occur.

The viscosity responsiveness or viscosity dependence of the metering throttle member is achieved by a radial flow cross section of a metering throttle bore of small flow area in relation to the surface wetted by the flowing stream of oil therein. The wetted surface is determined by the periphery of the flow cross sectional area and the length of the metering throttle bore. Because a peripheral layer of oil is thicker for cold, i.e., viscous oil, the effect of the surface contact is greater than in the case of warm, i.e., thin bodied oil.

In order to effect precise regulation of the oil stream, it is advantageous to have a viscosity independent restrictor bore upstream of the viscosity responsive throttle. Thus, there is achieved as a result of the restrictor bore regulation, a close regulation while as a result of the viscosity responsive metering throttle, prevention of noise will be effected.

The purpose of the invention may be achieved simply by means of a metering throttle, viz, a tube with a bore having a cross section corresponding approximately to the cross section of the restrictor bore and the length of which is greater as compared to the length of the restrictor bore and as compared to the diameter of the viscosity responsive bore. This may be achieved particularly simply by a composite bore of constant cross section, whereby the upstream portion is a restrictor bore of a relatively short length and a second portion is angularly oriented to the first portion and has a relatively great length.

An advantageous development of the invention comprises a rod of polygon cross section, for example, a square rod, is inserted into the bore of the metering throttle member, the edges of which rod fit within the inside wall of the bore and support the rod therein.

A detailed description of the invention now follows in conjunction with the appended drawing, in which:

FIG. 3 is a partial section similar to that of FIG. 2, but of modified metering bore;

FIG. 4 is a cross section on the line IV—IV of FIG. 3; and

FIG. 5 is a graph showing the dependence on oil temperature of pump discharge related to pump speed.

Figure 1:
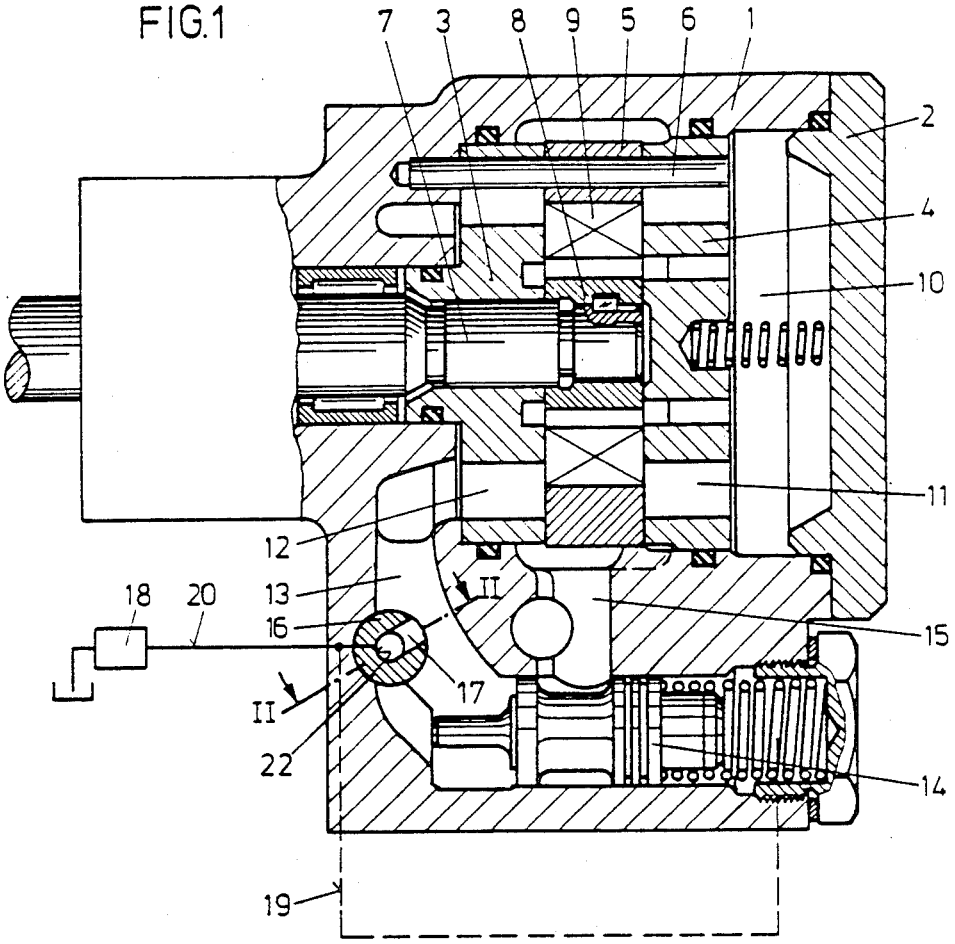
FIG. 1 is a longitudinal section through a rotary vane pump with flow regulating components.

In a housing 1 which is closed by a cover 2, a cam ring 5 is disposed between two cheek plates 3 and 4. A pin 6 secures the cam ring 5 and the two cheek plates 3 and 4 against rotation. In the cam ring 5, a pump rotor 8 is rotated by a drive shaft 7. Slide vanes 9 move radially in slots of the rotor 8. Between the second cheek plate 4 and the cover 2, a pressure chamber 10 is formed in the housing 1 which connects with a pressure passage 13 via outlets 11 and 12 in the cheek plates 4 and 3. Depending on the pump speed, a flow regulating piston valve 14 bypasses excess oil from the pressure passage 13 into a pump bypass passage 15, which is a suction inlet, all as is generally known.

Figure 2:
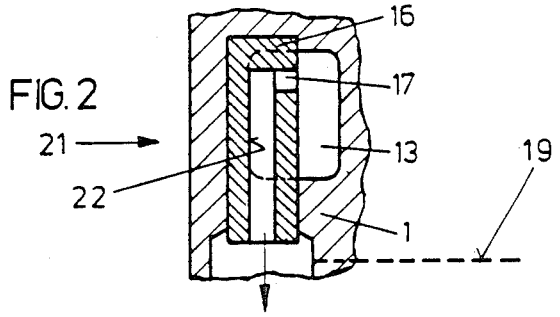
FIG. 2 is a partial section on the line II—II of FIG. 1.

In the outlet pressure passage 13, between the pressure chamber 10, the outlet 12 and the flow regulating valve 14, a tubular throttle insert 16 is disposed having an angularly related throttle passage 17, referred to herein as a throttle, bore 17. In this instance, the throttle insert 16 is oriented transversely to the axis of the pressure passage 13. With regard to the axis of the pressure passage 13, however, the specific position of the tubular throttle insert, 16 as shown, is not essential to its particular purpose and may be different for different requirements. Also, the throttle bore 17 may be disposed directly in the housing 1. By way of the throttle bore 17, pressure oil flows from the pump to a consumer 18 e.g. a sevosteering system. In a known manner, a reduced pressure will be transferred by way of a damping throttle, not shown in the drawing, through a passage 19 from a pressure outlet passage 20 which feeds the consumer 18. Such damping throttle feeds comsumer pressure to the opposite face of the flow regulating valve 14. For such damping throttle, see Clark, U.S. Pat. No. 3.314,495 (FIG. 2) passage 48. Also see Ilg, U.S. Pat. No. 4,564,338 (FIG. 1) passage 27.

A metering throttle member 21 effecting viscosity responsive flow is downstream of throttle bore 17. In the embodiment shown in FIGS. 1 and 2 the metering throttle member 21 has an elongated metering throttle bore 22, the cross section of which corresponds approximately to the cross section of the throttle bore 17. The length of the bore in throttle member 21 is large as compared to the length of the throttle bore and as compared to the inside diameter of the bore 22. In this case, the ratio of the surface determined by the length and the periphery of the metering throttle bore, wetted by the oil stream flowing to the consumer 18, to the radial cross section flow area of the throttle bore 17 is greater than 20:1. Such ratio causes metering throttle bore 21 to be a viscosity responsive passage whereby cold, i.e., viscous oil, shifts regulating valve 14 to bypass the pump discharge to the pump inlet during engine start up.

In the modification shown in FIGS. 3 and 4 the metering throttle has a bore 23 into which a flow reducing member such as a square rod 24 is inserted, the longitudinal edges of which fit within the inside wall of the bore 23 for support of the rod. Between the bore 23 and the square rod 24, four flow areas 25 are formed which are of partially circular cross section, which determine the effective flow cross section through the metering throttle member 21. The use of a square rod flow control is found to be particularly advantageous, since the viscosity responsive friction in relation to the dimensional size of the throttle is even more effective than in the embodiment of FIG. 2. However, the use of rods with other polygonal shapes is believed possible. Likewise, the use of a round rod is possible, whereby a ring shaped flow passage is formed between the outside peripheral surface of the round rod and the inside wall of the bore 23 is believed to be of possible use.

As a result of the teaching of the metering throttle member as disclosed herein the final regulation of the pump output becomes effective at low temperatures, viz., flow to the consumer at a lower volume than at higher temperatures. The resultant regulation occurs always at the same pressure difference acting on the regulating valve 14. Since a smaller quantity of oil flows to the consumer 18, less oil will have to be drawn from the oil tank. For this smaller quantity of oil, the injector effect of the bypass flow is sufficient so that cavitation will be nearly completely prevented.

The effect of the flow regulating uniqueness of the invention on the flow to the consumer is shown in FIG. 5. Thus, FIG. 5 shows that the pump discharge volume V is regulated at a temperature of 20 C. before regulation at a temperature of 80 C. occurs.

As an example of an operable prototype through a test range from −4° F. to 68° F., the ambient temperature was the same as the initial oil temperature, a factor responsive to room temperature of the pump. The diameter of the bores 17 and 22 was 4 mm. the length of bore 17 was 4 mm., while the length of bore 22 was 25 mm. The pressure difference between the upstream and downstream pressures of the throttle member 21 was 1.6 bar.

Accordingly, at low temperatures, a larger part of the output oil is circulated in the pump. This results in elimination of undesirable noises and the prevention of cavitation.

OPERATION

The shift of valve 14 is always under the same differential pressure. However, due to the novel construction of the member 16, there is a flow restricting effect of oil flow from pressure passage 13 to consumer 18 under control of a steering control valve (not shown) of the open circuit type. When the oil is cold, as when the engine is starting up, it is more viscous. The control effect of throttle bore 17 (see U.S. Pat. No. 3,989,414) coacts with the metering throttle bore 22 to cause a pressure increase in pressure passage 13. This causes the bypass valve to open since the pressure on the left side of the valve is greater than the back pressure from the consumer 18 via line 19.

This is due to the large pressure drop across throttle member 21 effected by cold, viscous, oil and the inherent flow friction of throttle member 21.

As a result, cold oil and its attendant viscosity causes bypass flow from passage 13 to pump inlet bypass passage 15, a flow responsive to oil viscosity, thus dependent on oil temperature Then, at startup of the engine, the oil circulating in the pump from outlet back to inlet is much larger than would be the case for power steering vane pumps of the prior art. Accordingly, the amount of oil which would be drawn from a tank to passage 15 for feed to the pump inlet would be less than that drawn by prior art pumps, and therefore with a reduction in noise.

The aspiration or injector effect of the oil circulating in passage 15 on entraining oil from a tank is increased as compared with the prior art which aids in suction flow from a tank to the pump. Additionally, the increase of circulating oil results in improved filling of the pumping chambers between the pump vanes to minimize cavitation.

An important improved effect of the invention is that the increase of circulatory flow in the pump decreases the time taken for the oil to heat up. This limits the noise period of the pump on engine startup.

A preferred form of the invention is the flow restrictor type as shown in FIGS. 3 and 4.

We claim:

1. In a rotary vane pump having a pump pressure outlet and a pump suction inlet and having regulation of pressure agent flow to a consumer (18) by means of a bypass valve (14) operable by pump output pressure flow in a pump pressure outlet passage (13) whereby said bypass valve is shifted by differential pressure between said putput pressure and consumer pressure for opening flow to a bypass passage (15) to bypass pump outlet flow to the suction inlet flow of said pump for circulatory flow between said pump pressure outlet and pump suction inlet including a combining flow from a tank to the bypass passage;

the improvement which comprises a metering throttle member (21) disposed to receive pump outlet flow from said pressure outlet passage (13) to a throttle passage (17) in said throttle member and said throttle member having a metering throttle passage (22) connecting to said throttle passage for passage of pressure agent flow to a consumer and effecting a reduced flow rate thereto by reason of high viscosity of cold pressure agent wherein initially cold pressure agent effects said reduced flow rate to increase circulatory flow and thus reduce the flow needed from a tank for maintaining full circulatory flow, wherein said metering throttle passage (22) has an area cross section for flow which is small enough as compared to the wetted area of passage therethrough for a pressure agent so as to produce increased flow friction expediting pump regulation for a cold pressure agent during pump start up by effecting initial decrease of flow to a consumer to maintain said circulatory flow by operation of said bypass valve without increasing the flow of initially cold pressure agent from the tank to said bypass passage, thereby reducing noise at start up.

2. In a rotary vane pump as set forth in claim 1, wherein said metering throttle bore has a small cross section flow area of less than a twentieth of the wetted surface area of said metering throttle bore.

3. In a rotary vane pump as set forth in claim 1, wherein said throttle bore is upstream of said metering throttle bore and disposed to conduct flow thereto.

4. In a rotary vane pump as set forth in claim 3, wherein said throttle bore is upstream of said metering throttle bore and substantially shorter than said metering throttle bore.

5. In a rotary vane pump as set forth in claim 4, wherein said metering throttle bore (22) has a flow cross section substantially that of said throttle bore (17).

6. In a rotary vane pump as set forth in claim 3, wherein said metering throttle bore has a length substantially greater than the diameter for effecting flow friction.

7. In a rotary vane pump having regulation of pressure agent flow to a consumer (18) through a bypass valve (14) operable by pump output pressure flow in a pump pressure outlet passage (13) whereby said bypass valve is shifted by differential pressure between said output pressure and consumer pressure for opening flow to a bypass passage (15) to bypass pump outlet flow to the suction inlet side of the pump for circulatory flow and thus combining pump suction flow from a tank to the bypass passage;

the improvement which comprises a metering throttle member (21) disposed to receive pump outlet flow from said pressure outlet passage (13) to a throttle bore (17) in said throttle member and said throttle member having a metering throttle bore (22) connecting to said throttle bore;

for passage of pressure agent flow to a consumer and effecting a flow rate thereto responsive to viscosity of said pressure agent wherein initially cold oil effects an increase in circulatory flow to reduce the flow needed from a tank and reduction in noise level of said latter flow;

wherein said metering throttle bore is a bore (22) in said metering throttle member (21), and a flow reducing member (25) inserted in said metering throttling bore for reducing the cross section flow area while increasing the surface area wetted by the pressure agent.

8. In a rotary vane pump as set forth in claim 7, said flow reducing member being a rod of polygonal cross section having edges fitting against walls of said metering throttle bore for support of said latter member therein.

9. In a rotary vane pump as set forth in claim 7, said latter member being of square cross section.

10. In a rotary vane pump having regulation of pressure agent flow to a consumer (18) through a bypass valve (14) operable by pump output pressure flow in a pump pressure outlet passage (13) whereby said bypass valve is shifted by differential pressure between said output pressure and consumer pressure for opening flow to a bypass passage (15) to bypass pump outlet flow to the suction inlet side of the pump for circulatory flow and thus combining pump suction flow from a tank to the bypass passage;

the improvement which comprises a metering throttle member (21) disposed to receive pump outlet flow from said pressure outlet passage (13) to a throttle bore (17) in said throttle member and said throttle member having a metering throttle bore (22) connecting to said throttle bore;

for passage of pressure agent flow to a consumer and effecting a flow rate thereto responsive to viscosity of said pressure agent wherein initially cold oil effects an increase in circulatory flow to reduce the flow needed from a tank and reduction in noise level of said latter flow;

said metering throttle member being within said pressure outlet passage (13) and comprising an elongated viscosity responsive passage (22) for conducting pressure agent flow to a consumer wherein the ratio of cross section flow area of said passage to the area wetted by pressure agent therein provides flow throttling sufficient to effect pressure buildup at cold start of said pump for actuating said bypass valve.

11. In a rotary vane pump as set forth in claim 10, said metering throttle member having a wall exposed in said pressure outlet passage and said throttle bore (17) being in said wall for passage of pressure agent therethrough to said metering throttle bore (22); said throttle bore being disposed in said metering throttle member (21) so that pressure agent through said throttle bore will traverse substantially the length of said metering throttle bore.

* * * * *